United States Patent [19]

Onishi

[11] 4,185,598

[45] Jan. 29, 1980

[54] INTERNAL COMBUSTION ENGINE

[75] Inventor: Shigeru Onishi, Kanazawa, Japan

[73] Assignee: Toyota Jidosha Kogyo Kabushiki Kaisha, Toyota, Japan

[21] Appl. No.: 826,123

[22] Filed: Aug. 19, 1977

[30] Foreign Application Priority Data

Aug. 25, 1976 [JP] Japan ..... 51-101899
Dec. 29, 1976 [JP] Japan ..... 51-158047

[51] Int. Cl.[2] ..... F02B 33/04
[52] U.S. Cl. ..... 123/73 A; 123/73 C
[58] Field of Search ..... 123/73 A, 73 C, 73 R, 123/65 A, 65 B, 65 E

[56] References Cited

U.S. PATENT DOCUMENTS

| | | | |
|---|---|---|---|
| 1,780,635 | 11/1930 | Spencer | 123/73 A |
| 3,195,524 | 7/1965 | Heidner | 123/73 A |
| 3,817,227 | 6/1974 | Onishi | 123/73 A |
| 3,929,111 | 12/1975 | Turner et al. | 123/73 A X |
| 4,075,985 | 2/1978 | Twai | 123/73 A |

*Primary Examiner*—Ira S. Lazarus
*Attorney, Agent, or Firm*—Stevens, Davis, Miller & Mosher

[57] ABSTRACT

Disclosed is an internal combustion engine capable of creating an active thermoatmosphere in the combustion chamber at the beginning of the compression stroke. The active thermoatmosphere continues to be maintained during the compression stroke when the engine is operating under a partial load. The self ignition of the active thermoatmosphere is caused in the vicinity of the top dead center position.

18 Claims, 18 Drawing Figures

6
2
Z
Z
5
3
1
15
17
18
13
16b
19
11
4
IV
IV
12
16
22
23
14
20
27
28
26
21
25
24
10
9
8
7

6
2
3
5
1
17
29
18
31
15
13
19
30
11
4
32
12
16
28
22
14
27
23
20
26
21
25
24
10
9
8
7

6
2
5
3
1
180'
17
29
18
31
15
13
19
19'
30
11
4
32
36
12
35
22
23
14
16
33
34
20
37
38
39
24
9
10
8
7

INTERNAL COMBUSTION ENGINE

DESCRIPTION OF THE INVENTION

The present invention relates to a method of active thermoatmosphere combustion and to an internal combustion engine of an active thermoatmosphere combustion type.

With regard to an internal combustion engine, for example, a 2-cycle engine, it has been known that self ignition of the fresh combustible mixture can be caused in the combustion chamber of an engine without the fresh combustible mixture being ignited by the spark plug. The combustion caused by the above-mentioned self ignition is conventionally called an extraordinary combustion or a run on. In the attached FIGS. 1 and 2, A shows the region of occurrence of the extraordinary combustion which is caused in a 2-cycle engine. In FIG. 1, the ordinate indicates the delivery ratio DR and the abscissa indicates the air-fuel ratio A/F. On the other hand, in FIG. 2, the ordinate indicates the delivery ratio DR and the abscissa indicates the number of revolutions per minute N of the engine. In addition, FIG. 1 shows the results of an experiment conducted under a constant engine speed of 2000 r.p.m. and FIG. 2 shows the results of an experiment conducted under a constant air-fuel ratio of 15:1.

In a 2-cycle engine, when the engine is operating at a high speed under a light load, wherein the above-mentioned extraordinary combustion is caused, the amount of residual exhaust gas remaining in the cylinder of the engine is much larger than that of the fresh combustible mixture fed into the cylinder. Therefore, the fresh combustible mixture fed into the cylinder is heated until it is reformed by the residual exhaust gas, which has a high temperature, and as a result, the fresh combustible mixture produces radicals. An atmosphere wherein radicals are produced as mentioned above is hereinafter called an active thermoatmosphere. However, when extraordinary combustion is caused, the active thermoatmosphere is extinguished at the beginning of the compression stroke, and hot spot ignitiion, mis-fire and explosive combustion caused by a spark plug are alternately repeated, thus, causing a great fluctuation of torque. Since the extraordinary combustion has drawbacks in that a great fluctuation of torque occurs as mentioned above and, in addition, the piston will melt due to the occurrence of the above-mentioned hot spot ignition, such an extraordinary combustion is conventionally considered an undesirable combustion.

The inventor conducted research on extraordinary combustion and, as a result, has proven that, if the active thermoatmosphere which is caused in the extraordinary combustion at the beginning of the compression stroke can continue to be maintained until the end of the compression stroke, self ignition of the active thermoatmosphere is caused in the combustion chamber of an engine without the thermoatmosphere being ignited by the spark plug and, then, the active thermoatmosphere combustion takes place. In addition, the inventor has further proven that this active thermoatmosphere combustion results in quiet engine operation and can be caused even if a lean air-fuel mixture is used. This results in a considerable improvement in fuel consumption and a considerable reduction in the amount of harmful components in the exhaust gas. Particularly in an engine for use in, for example, a vehicle, the majority of the operation of the engine is carried out under a partial load. Consequently, if the above-mentioned active thermostmosphere combustion is carried out under a partial load, the fuel consumption is considerably improved and the amount of harmful components is considerably reduced.

An object of the present invention is to provide an internal combustion engine and a method of operation thereof which are capable of always creating a stable active thermoatmosphere independent of the number of revolutions per minute of the engine when the engine is operating under a partial load.

According to the present invention, there is provided a method of combustion in an internal combustion engine having a combustion chamber therein, said method comprising the steps of:

restricting a fresh combustible mixture fed into the combustion chamber when the engine is operating under a partial load for maintaining the flow velocity of the combustible mixture flowing into the combustion chamber at a low level;

feeding the combustible mixture into the combustion chamber while suppressing the flow and turbulence of the burned gas in the combustion chamber and preventing the dissipation of the heat of the burned gas contained in the combustion chamber for maintaining the residual burned gas in the combustion chamber at a high temperature;

creating an active thermoatmosphere in the combustion chamber at the beginning of the compression stroke;

continuing to maintain the active thermoatmosphere until the end of the compression stroke and reforming the fresh combustible mixture; and causing self-ignition of the fresh combustible mixture.

In addition, according to the present invention, there is provided a 2-cycle internal combustion engine comprising:

a cylinder block having a cylinder bore and a crank room therein;

a piston having an approximately flat top surface and reciprocally moving in said cylinder bore, said piston and said cylinder bore defining a combustion chamber;

a scavenging passage having a scavenging port which opens into said combustion chamber and communicating said combustion chamber with said crank room for feeding a fresh combustible mixture into said combustion chamber, said scavenging port being arranged to be directed to an approximately central portion of the combustion chamber;

an exhaust passage having an exhaust port opening into said combustion chamber for discharging the burned gas from said combustion chamber into the atmosphere; and restricting means disposed in said scavenging passage at a position near the position wherein said scavenging passage opens into said crank room for restricting the flow velocity of the fresh combustible mixture fed into said combustion chamber when the engine is operating under a partial load and for creating an active thermoatmosphere in said combustion chamber to cause the self ignition of the fresh combustible mixture.

Futhermore, according to the present invention, there is provided an internal combustion engine of the type wherein the intake stroke is started after the exhaust stroke is completed, said engine comprising:

a housing having a bore therein;

a piston movable in said bore, said piston and said bore defining at least one combustion chamber;

an intake passage communicating said combustion chamber with the atmosphere for feeding a fresh combustible mixture into said combustion chamber;

an exhaust passage communicating said combustion chamber with the atmosphere for discharging the burned gas into the atmosphere; and restricting means in said intake passage for reducing the flow velocity of the fresh combustible mixture fed into the combustion chamber, which is smaller than the flow velocity in an ordinary engine, when the engine is operating under a partial load.

The present invention may be more fully understood from the following description of preferred embodiments of the invention, together with the accompanying drawings.

Figure 3:
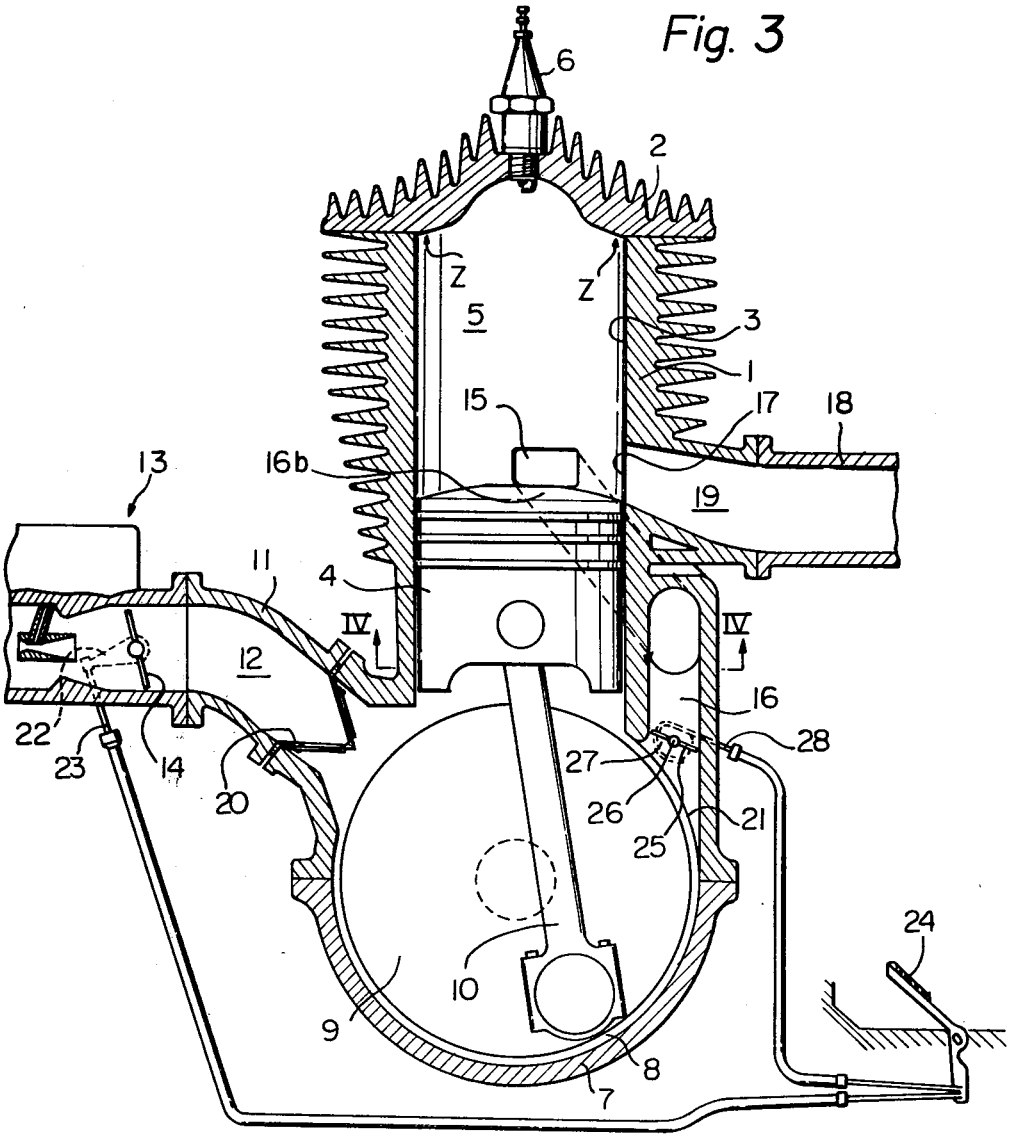
FIG. 3 is a cross-sectional side view of an embodiment of a 2-cycle engine according to the present invention.
Figure 8:
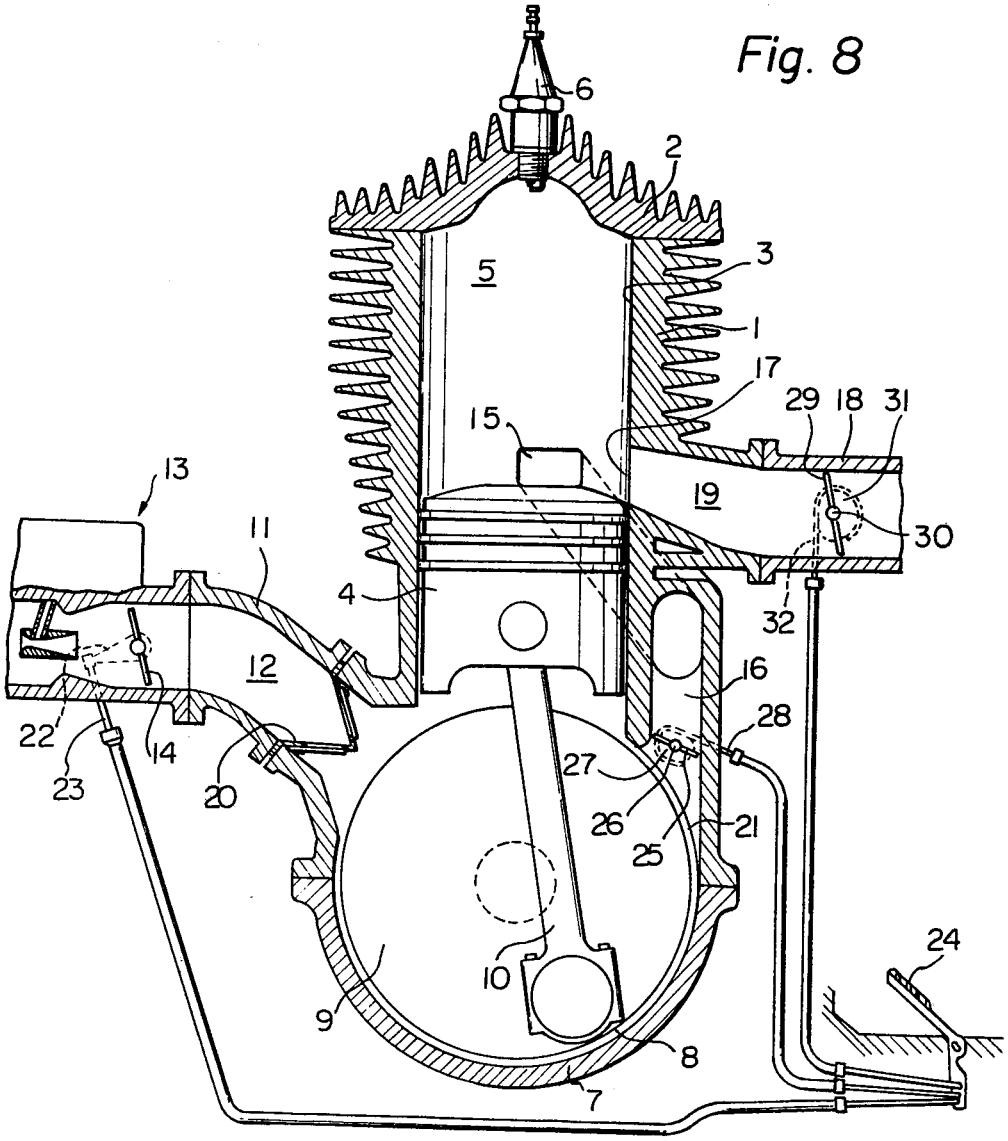
Figure 9:
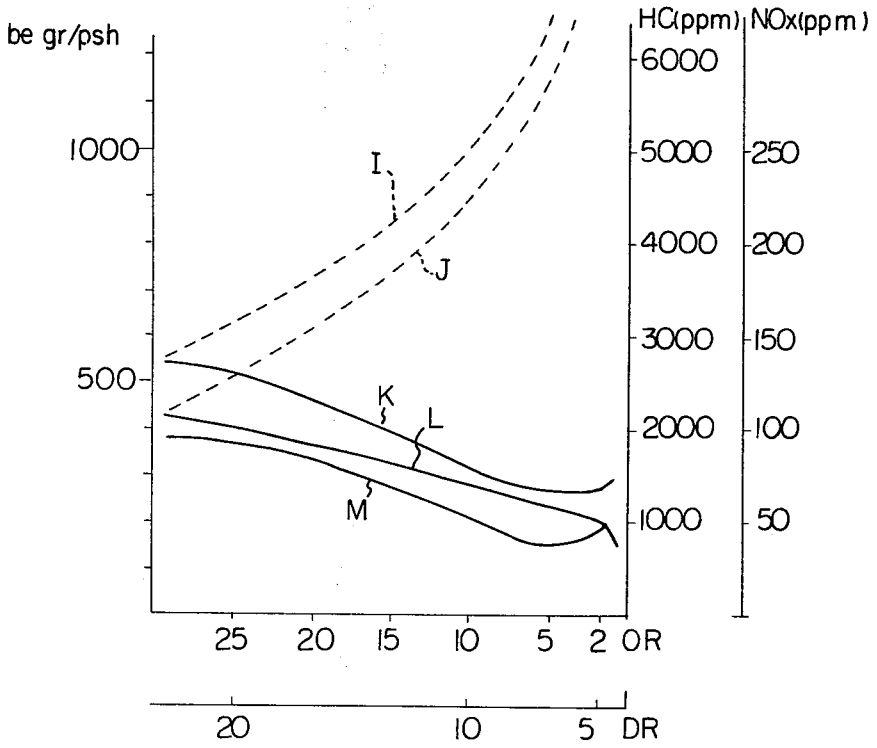
Figure 10:
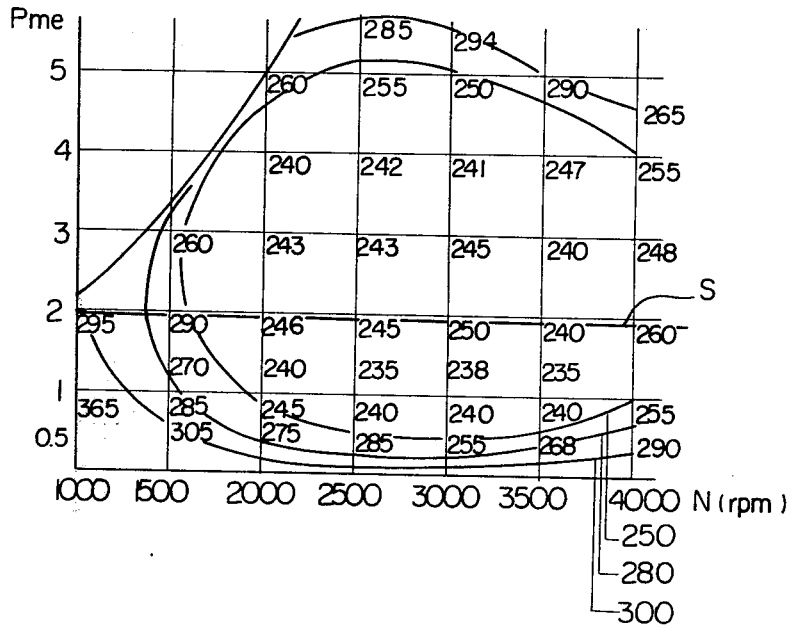
Figure 11:
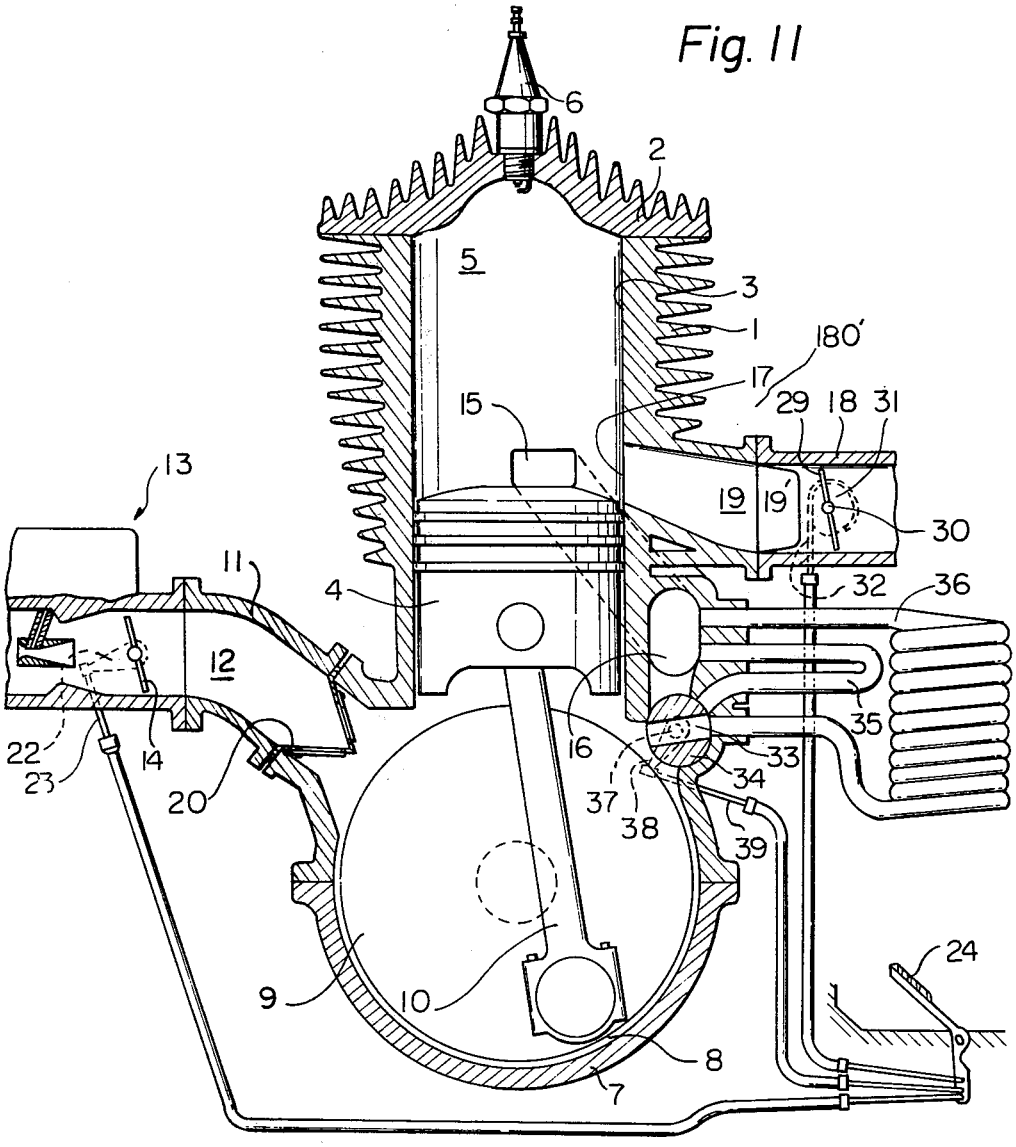
Figure 12:
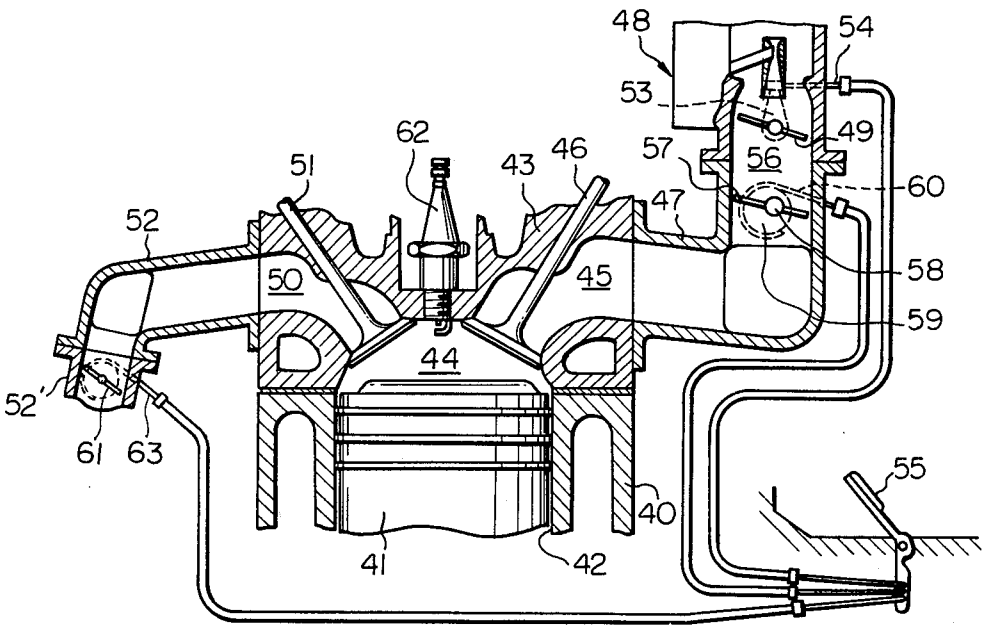
Figure 13:
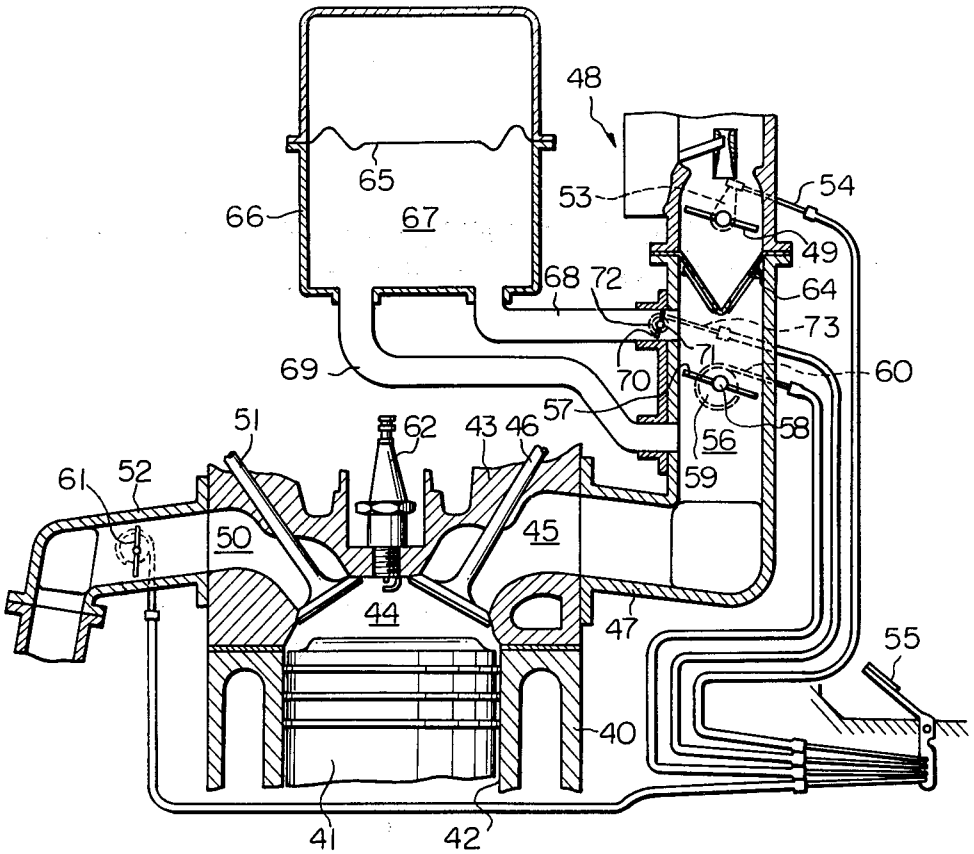
Figure 14:
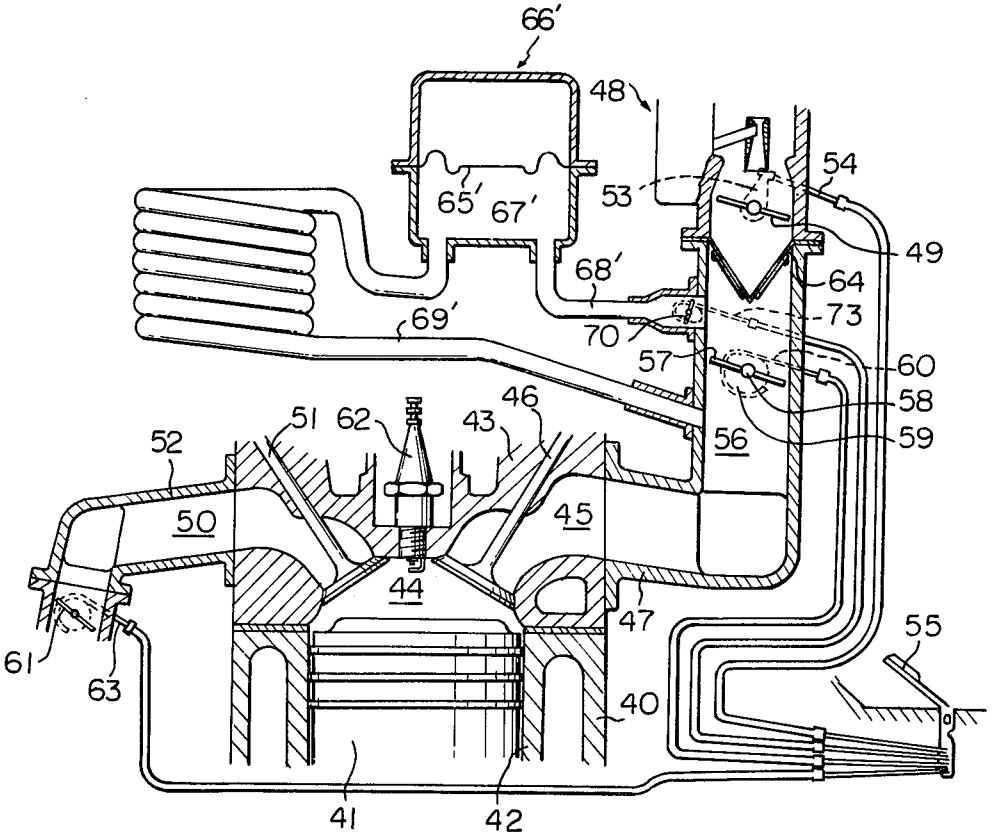
Figure 15:
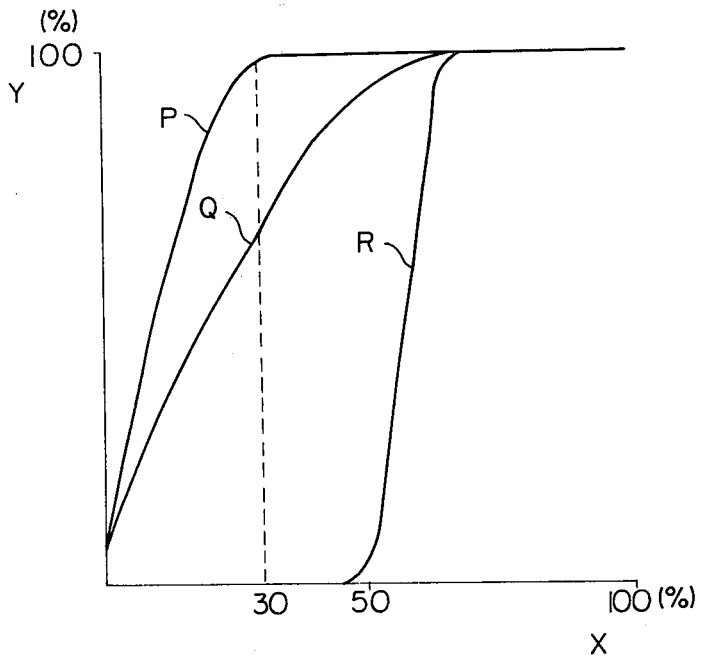
Figure 16:
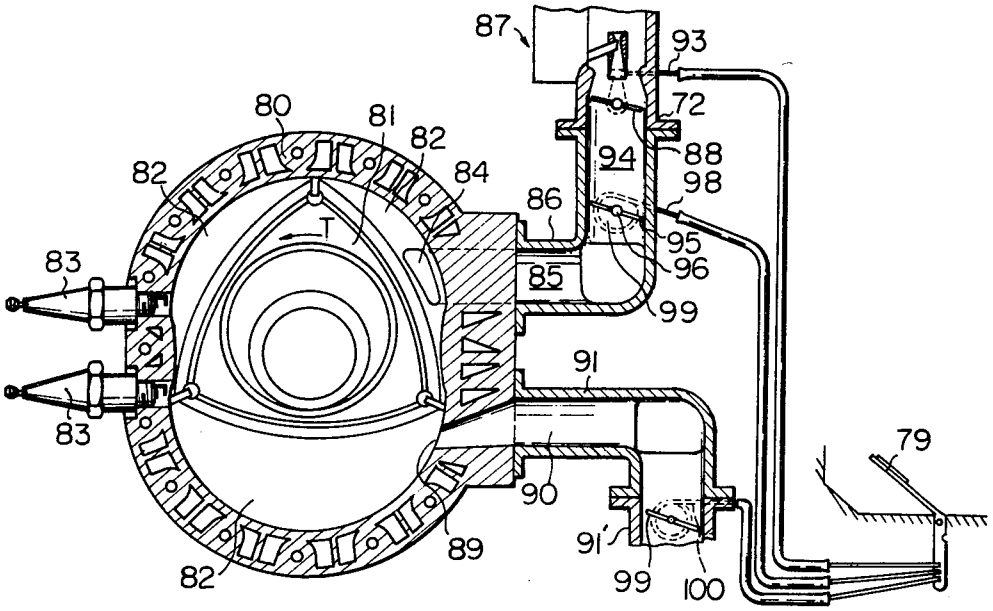
Figure 17:
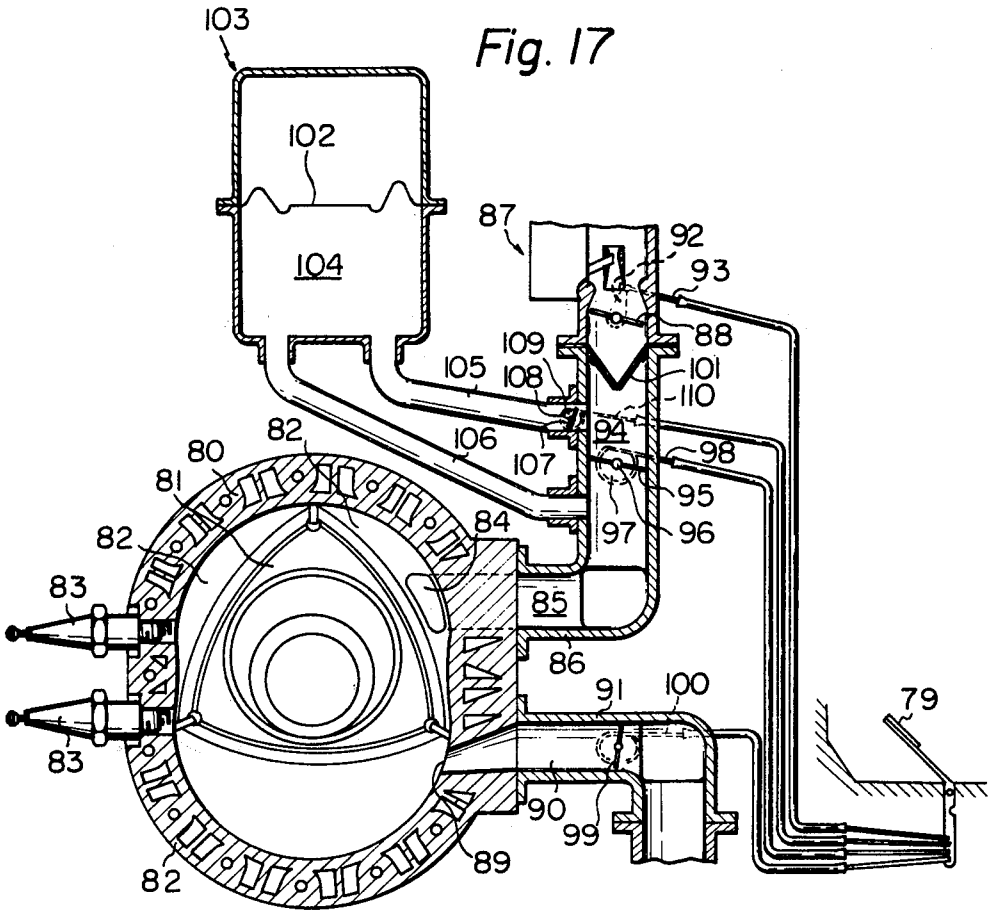

FIG. *7a* is a diagram showing the scavenging and exhaust strokes of the engine shown in FIG. 3;

FIG. *7b* is a graph showing the velocity of the fresh combustible mixture flowing into the combustion chamber from the scavenging port and showing the actual scavenging timing caused by the fresh combustible mixture in the engine shown in FIG. 3;

FIG. 8 is a cross-sectional side view of another embodiment of a 2-cycle engine according to the present invention;

FIG. 9 is a graph showing the specific fuel consumption and the concentrations of HC and $NO_x$ in the exhaust gas in the engine shown in FIG. 8;

FIG. 10 is a graph showing the specific fuel consumption in the engine shown in FIG. 8;

FIG. 11 is a cross-sectional side view of a further embodiment of a 2-cycle engine according to the present invention;

FIG. 12 is a cross-sectional side view of an embodiment of a 4-cycle engine according to the present invention;

FIG. 13 is a cross-sectional side view of an another embodiment of a 4-cycle engine according to the present invention;

FIG. 14 is a cross-sectional side view of a further embodiment of a 4-cycle engine according to the present invention;

FIG. 15 is a graph showing changes in the opening areas of the flow control valve, the exhaust control valve and the throttle valve;

FIG. 16 is a cross-sectional side view of an embodiment of a rotary-piston type engine according to the present invention; and FIG. 17 is a cross-sectional side view of an alternative embodiment of a rotary piston type engine according to the present invention.

DESCRIPTION OF PREFERRED EMBODIMENTS

Figure 1:
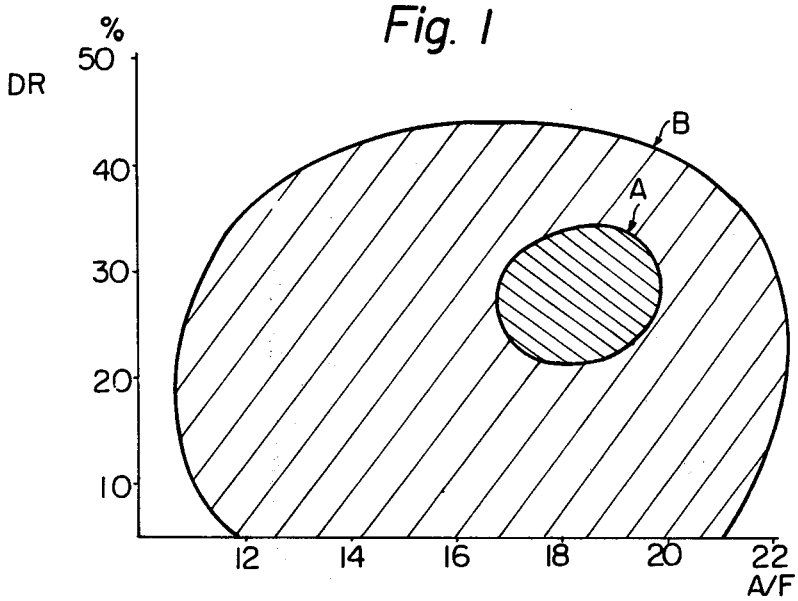
FIGS. 1 and 2 are graphs showing the region of the occurrence of the active thermoatmosphere combustion.
Figure 4:
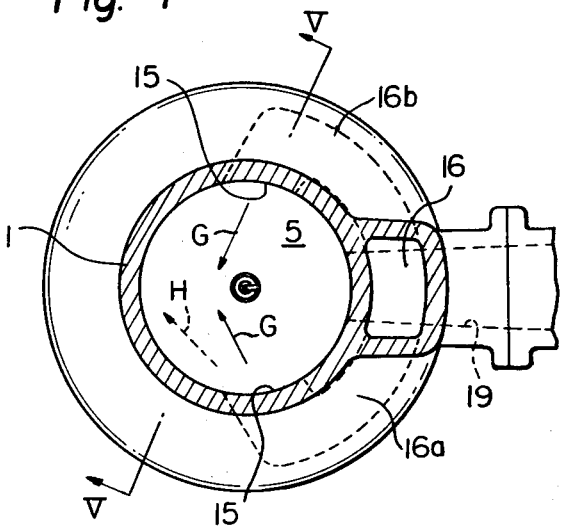
FIG. 4 is a cross-sectional view taken along the line IV—IV in FIG. 3.

FIGS. 3 and 4 show the case wherein the present invention is applied to a Schnurle type 2-cycle engine. In FIGS. 3 and 4, 1 designates a cylinder block, 2 a cylinder head fixed onto the cylinder block 1, 4 a piston having an approximately flat top face and reciprocally moving in a cylinder bore 3 formed in the cylinder block 1 and 5 a combustion chamber formed between the cylinder head 2 and the piston 4; 6 designates a spark plug, 7 a crank case, 8 a crank room formed in the crank case 7 and 9 a balance weight; 10 designates a connecting rod, 11 an intake pipe, 12 an intake passage and 13 a carburetor; 14 designates a throttle valve of the carburetor 13, 15 a pair of scavenging ports, 16 a scavenging passage and 17 an exhaust port; 18 designates an exhaust pipe, 19 an exhaust passage and 20 a reed valve which permits the inflow of a fresh combustible mixture into the crank room 8 from the intake passage 12. The scavenging passage 16 opens into the crank room 8 at an opening 21, on one hand, and is divided into two branches *16a*, *16b* which open into the combustion chamber 5 at scavenging ports 15, on the other hand. An arm 22 is fixed onto the throttle valve 14, and the tip of this arm 22 is connected via a wire 23 to an accelerator pedal 24 which is disposed in the driver's compartment. On the other hand, a scavenging control valve 25 is disposed in the scavenging passage 16 at a position near the opening 21 and is fixed onto a valve shaft 26 pivotably mounted on the cylinder block 1. A cam 27 is mounted on the valve shaft 26, and a wire 28 which is wound on the outer periphery of the cam 27 is connected to the accelerator pedal 24. Consequently, when the accelerator pedal 24 is depressed, the throttle valve 14 and the scavenging control valve 25 are opened.

Figure 6:
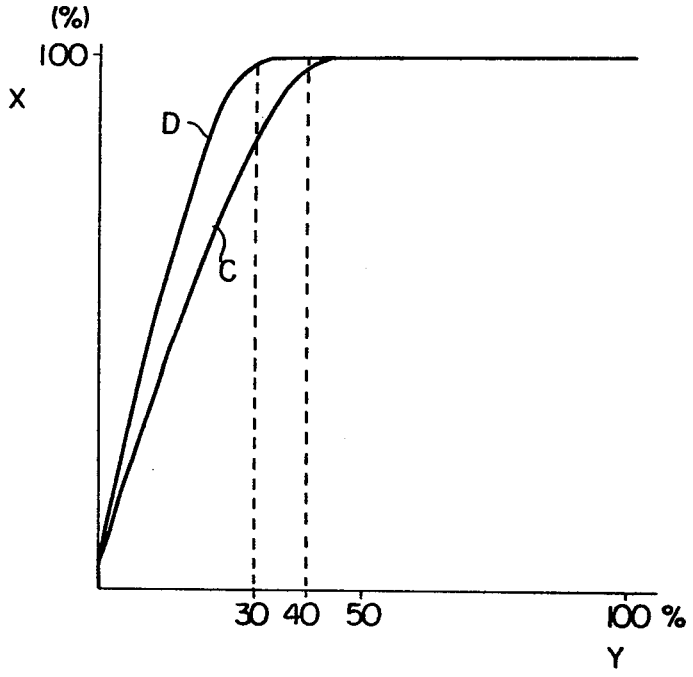
FIG. 6 is a graph showing the change in the opening area of the scavenging control valve and the exhaust control valve in the engine shown in FIG. 3.

FIG. 6 indicates changes in opening areas of the throttle valve 14 and the scavenging control valve 25. In FIG. 6, the ordinate X indicates the ratio of an opening area to the full opening area of the scavenging control valve 25, and the abscissa Y indicates the ratio of an opening area to the full opening area of the throttle valve 14. The relationship between the above-mentioned opening area ratios of the throttle valve 14 and the scavenging control valve 25 is shown by the curved line C in FIG. 6. As is apparent from FIG. 6, the scavenging control valve 25 is gradually opened and then fully opened before the throttle valve 14 reaches a position corresponding to the opening area ratio X of approximately 40 percent. In addition, the scavenging control valve 25 remains fully opened when the throttle valve 14 is further opened. Consequently, in FIG. 3, the cam 27 is connected to the valve shaft 26 in such a manner that the cam 27 rotates together with the valve shaft 26 until the time the acceleration pedal 24 is depressed to a particular extent and, then, when the acceleration pedal 24 is further depressed after the scavenging control valve 25 is fully opened, only the cam 27 rotates. As mentioned above, the scavenging passage 16 is throttled by means of the scavenging control valve 25 when the engine is operating under a partial load, so that the throttling operation of the scavenging passage 16 is strengthened as the load of the engine is reduced.

In operation, a fresh combustible mixture introduced into the crank room 8 from the intake passage 12 via the reed valve 20 is compressed as the piston 4 moves downwards. Then the fresh combustible mixture under pressure in the crank room 8 flows into the combustion chamber 5 from the scavenging ports 15 via the scavenging passage 16 when the piston 4 opens the scavenging ports 15. At this time, if the scavenging control valve 25 remains slightly opened, the stream of the fresh combustible mixture flowing into the combustion chamber 5 from the crank room 8 via the scavenging passage 16 is restricted by the scavenging control valve 25. As a result of this, the flow velocity of the fresh combustible mixture is reduced. Since the flow velocity of the fresh combustible mixture is low throughout the inflow operation of the fresh combustible mixture, due to the restricting operation of the scavenging control valve 25, the flow of the residual burned gas in the combustion chamber 5 is extremely small and, as a result, the dissipation of the heat of the residual burned gas is prevented. In addition, at the beginning of the compression stroke under a partial load of the engine, a large amount of the residual burned gas is present in the combustion chamber 5. Since the amount of the residual burned gas in the combustion chamber 5 is large and, in addition, the residual burned gas has a high temperature, the fresh combustible mixture is heated until it is reformed by the residual burned gas and, as a result, an active thermoatmosphere is created in the combustion chamber 5. Further, since the flow of the gas in the combustion chamber 5 is extremely small during the compression stroke, the occurrence of turbulence and the loss of heat energy are restricted to the smallest possible extent. Consequently, the active thermoatmosphere thus created continues to be maintained during the compression stroke and, as a result, the self ignition of the active thermoatmosphere is caused; consequently, the combustion is advanced while being controlled by the residual burned gas. As mentioned previously, this ignition is not caused by the spark plug 6. When the piston 4 moves downwards and opens the exhaust port 17, the burned gas in the combustion chamber 5 is discharged into the exhaust passage 19.

As mentioned above, in order to cause the active thermoatmosphere combustion, it is necessary to continue to maintain the active thermoatmosphere until the end of the compression stroke. However, it is impossible to continue to maintain the active thermoatmosphere until the end of the compression stroke by merely throttling the scavenging passage 16 by means of the scavenging control valve 25 disposed in the scavenging passage 16. That is, if a flow or turbulence of the residual burned gas in the combustion chamber 5 is caused, the heat of the residual burned gas escapes into the cylinder wall. As a result of this, since the residual burned gas is cooled, it is impossible to continue to maintain the active thermoatmosphere until the end of the compression stroke. The fresh combustible mixture flowing into the combustion chamber 5 from the scavenging port 15 has a great influence on the creation of the above-mentioned flow and turbulence of the residual burned gas. According to the experiments conducted by the inventor, it has been proven that the velocity of the fresh combustible mixture flowing into the combustion chamber, the inflow direction of the fresh combustible mixture and the strength of the turbulence of the fresh combustible mixture immediately before the fresh combustible mixture flows into the combustion chamber have a great influence on the creation of the flow and the turbulence of the residual burned gas.

Figure 7:
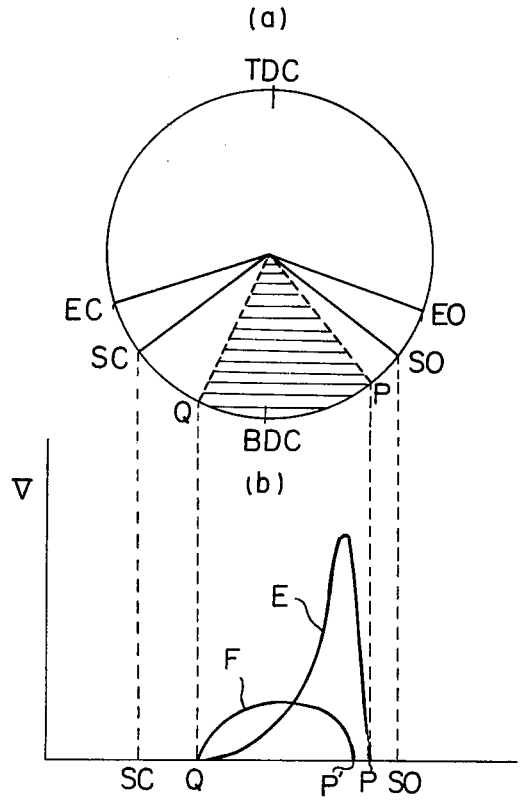

FIG. 7(*a*) is a diagram illustrating the opening and closing timings of the scavenging and the exhaust ports of the 2-cycle engine shown in FIG. 3. FIG. 7(*b*) is a graph wherein the ordinate indicates the velocity V of the fresh combustible mixture flowing into the combustion chamber from the scavenging port and the abscissa indicates the crank angle. In FIGS. 7(*a*) and (*b*), EO indicates the opening timing of the exhaust port, SO the opening timing of the scavenging port, SC the closing timing of the scavenging port and EC the closing timing of the exhaust port; P indicates the timing of the start of the inflow of the fresh combustible mixture into the combustion chamber from the scavenging port and Q the timing of the completion of said inflow of the fresh combustible mixture. In the crank angle between SO and P in FIGS. 7(*a*) and (*b*), even if the scavenging port is opened, since the pressure in the combustion chamber is lower than that in the scavenging passage, the burned gas in the combustion chamber does not flow into the scavenging passage. On the other hand, when the piston starts the upward movement after it reaches the bottom dead center position, the pressure in the combustion chamber is again increased. As a result, in the crank angle between Q and SC in FIGS. 7(*a*) and (*b*), since the pressure in the combustion chamber becomes higher than that in the scavenging passage, the gas in the combustion chamber flows backwards into the scavenging passage. Consequently, the fresh combustible mixture flows into the combustion chamber from the scavenging port during the time period shown by the hatching in FIG. 7(*a*). In FIG. 7(*b*), the curved line E shows change in velocity V of the fresh combustible mixture flowing into the combustion chamber from the scavenging port in a conventional 2-cycle engine. As is apparent from FIG. 7(*b*), in a conventional engine, since the fresh combustible mixture flows into the combustion chamber at a high speed at the beginning of the inflow thereof, a strong turbulence and flow of the residual burned gas in the combustion chamber are caused by the fresh combustible mixture and, as a result, it is impossible to continue to maintain the active thermoatmosphere until the end of the compression stroke. Contrary to this, by throttling the scavenging passage 16 by means of the scavenging control valve 25 as indicated in FIG. 3, the velocity V of the fresh combustible mixture flowing into the combustion chamber 5 from the scavenging ports 15 becomes low throughout the scavenging operation caused by the fresh combustible mixture as shown by the curved line F in FIG. 7(*b*). In addition, as is shown by the point P′ in FIG. 7(*b*), the start of the inflow operation of the fresh combustible mixture is delayed as compared to that, shown by P, in conventional engine. Consequently, since the fresh combustible mixture gently flows into the residual burned gas, it is possible to minimize the turbulence and flow of the residual burned gas. In addition, in order to reduce the flow velocity of fresh combustible mixture entering into the combustion chamber 5 from the scavenging ports 15, it is preferable that the scavenging passage 16 be so formed that the cross-sectional area of the scavenging passage 16 is gradually increased towards the scavenging ports 15. Furthermore, the arrangement of the scavenging control valve 25 causes turbulence of the fresh combustible mixture flowing in the scavenging passage 16. However, by positioning the scavenging control valve 25 at a position as remote as possible from the scavenging ports 15, that is, at a position near the opening 21, the turbulence created by the scavenging valve 25 is extinguished in the scavenging passage 16, and in addition, an approximately laminar flow of the fresh combustible mixture is caused in the scavenging passage 16. As a result of this, the fresh combustible mixture generating extremely weak turbulence therein flows into the combustion chamber 5 from the scavenging port 15.

Figure 5:
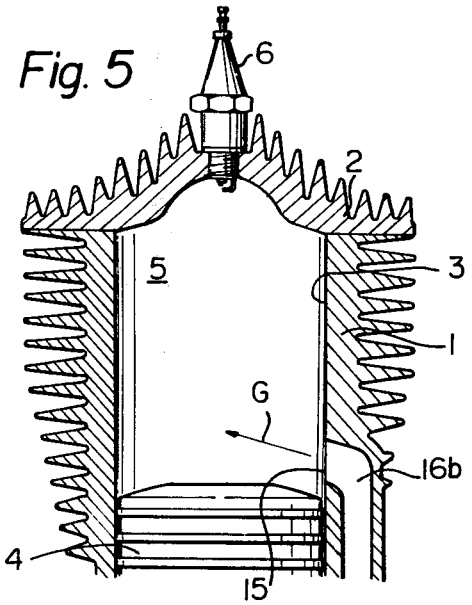
FIG. 5 is a cross-sectional view taken along the line V—V in FIG. 4.

In addition, it is necessary to construct the scavenging ports 15 so that, as is shown by the arrows G in FIG. 4, the fresh combustible mixture flows into the combustion chamber 5 towards an approximately central portion of the combustion chamber 5 and, at the same time, as is shown by the arrow G in FIG. 5, the fresh combustible mixture flows into the combustion chamber 5 slightly upwards. That is, if the scavenging ports 15 are so constructed that the fresh combustible mixture flows into the combustion chamber 5 along the circumferential wall of the cylinder as shown by the arrow H in FIG. 4, the fresh combustible mixture causes turbulence and flow of the residual burned gas prevailing on the circumferential wall of the cylinder. As a result of this, since the heat of the residual burned gas in the combustion chamber easily escapes into the cylinder wall, it is difficult to continue to maintain the active thermoatmosphere until the end of the compression stroke.

By the above-mentioned preferred arrangements and constructions of the scavenging control valve 25, the scavenging passage 16 and the scavenging ports 15, since the fresh combustible mixture flowing into the combustion chamber 5 from the scavenging ports 15 does not cause turbulence and flow of the residual burned gas and does not disperse in the combustion chamber 5, the dissipation of the heat of the residual burned gas is prevented. As a result of this, an active thermoatmosphere continues to be maintained until the end of the compression stroke and, in the region of the partial load shown by B in FIGS. 1 and 2, active thermoatmosphere combustion is carried out.

In addition, as is shown in FIG. 3, it is preferable that the cylinder head 2 be so constructed that an annular squish area Z is formed between the cylinder head 2 and the peripheral portion of the top face of the piston 4 when the piston 4 reaches the top dead center position. In this case, the propagation of the flame created by the self ignition of the active thermoatmosphere is controlled by the squish flow which is caused when the piston 4 reaches the top dead center position, thus preventing the occurrence of detonation. As a result of this, a stable active thermoatmosphere combustion can be carried out.

In the 2-cycle engine shown in FIG. 3, as is shown by the curved line C in FIG. 6, the scavenging control valve 25 remains fully opened when the opening area ratio Y of the throttle valve is larger than 40 percent. Consequently, when the opening area ratio Y of the throttle valve becomes larger than 40 percent, ordinary combustion which is caused by the spark plug 6 is carried out.

As mentioned previously, in order to continue to maintain the active thermoatmosphere until the end of the compression stroke, it is necessary to minimize the turbulence and the flow of the residual burned gas in the combustion chamber. Two causes of turnbulence and flow of the residual burned gas are an abrupt blowing off operation of the exhaust gas discharging from the exhaust port 17 (FIG. 3) and interference by the pulsating pressure of the exhaust gas. In order to prevent the above-mentioned abrupt blowing off operation and interference, as is shown in FIG. 8, it is preferable that an exhaust control valve 29 be disposed in the exhaust passage 19. The exhaust control valve 29 is fixed onto a valve shaft 30 pivotably mounted on the exhaust pipe 18, and a cam 31 is mounted on the valve shaft 30. Similar to the scavenging control valve 25, a wire 32 is wound on the outer periphery of the cam 31 and is connected to the accelerator pedal 24. The relationship between the opening area ratios of the exhaust control valve 29 and the throttle valve 14 is shown by the curved line D in FIG. 6. In addition, in order to appropriately prevent the exhaust gas from being abruptly discharged from the exhaust port 17, it is preferable that the volume of the exhaust passage 19 located between the exhaust port 17 and the exhaust control valve 29 be smaller than that of the combustion chamber 5 when the piston is positioned at the bottom dead center position.

Figure 2:
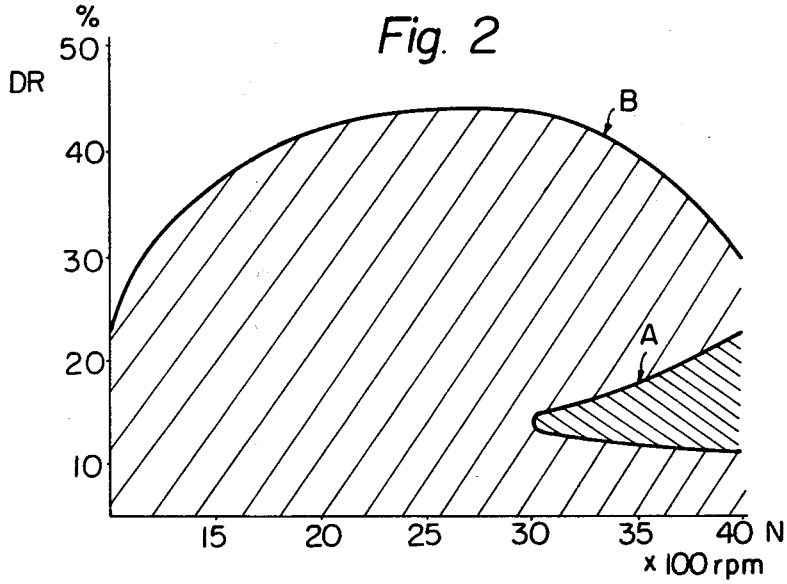

FIGS. 9 and 10 indicate the results of experiments conducted by using an engine as illustrated in FIG. 8. The engine used had a single cylinder of 372 cc and an effective compression ratio of 7.9:1. In addition, the experiments related to FIG. 9 were conducted under a constant engine revolution speed of 1500 r.p.m. and a constant airfuel ratio of 16:1 by changing the delivery ratio within the range of 5 through 2 percent. In FIG. 9, the ordinate indicates specific fuel consumption be (gr/Ps-h), concentration of HC (ppm) and concentration of $NO_x$ (ppm), and the abscissa indicates the ratio OR(%) of the opening area to the full opening area of the exhaust control valve, and the delivery ratio DR(%). In addition, in FIG. 9, the curved broken lines I and J indicate the specific fuel consumption be (gr/Ps-h) and concentration of HC, respectively, in a conventional 2-cycle engine; while the curved solid lines K, L and M indicate the specific fuel consumption be, concentration of $NO_x$ and concentration of HC, respectively, in a 2-cycle engine according to the present invention. As is apparent from FIG. 9, the specific fuel consumption be and the concentration of HC in an engine according to the present invention are considerably reduced as the load of the engine is reduced, that is, the delivery ratio DR is decreased as compared with those in a conventional engine. FIG. 10 shows the specific fuel consumption of a 2-cycle engine according to the present invention. In FIG. 10, the ordinate indicates the mean effective pressure Pme, and the abscissa indicates the number of revolutions per minute of the engine N(r.p.m.). In addition, in FIG. 10, the numerals appearing in the graph indicate the specific fuel consumption (gr/Ps-h). Furthermore, in FIG. 10, the region located beneath the solid line S is the region wherein the active thermoatmosphere combustion is carried out. As is shown in FIGS. 1, 2 and 10, active thermoatmosphere combustion is carried out under a partial load of the engine over the entire range of the number of engine revolutions per minute and over a wide range of the air-fuel ratio. Particularly, as is indicated in FIG. 1, active thermoatmosphere combustion can be carried out by using a lean air-fuel mixture having an air-fuel ratio of 16 through 21:1. Consequently, there is an advantage in that the amount of harmful HC, CO and $NO_x$ components in the exhaust gas can be simultaneously reduced.

FIG. 11 illustrates a further embodiment of a 2-cycle engine according to the present invention. Referring to FIG. 11, a switching valve 34 having a through-hole 33 therein is disposed in the scavenging passage 16 at a position near the crank room 8. A first bypass passage 35 and a second bypass passage 36 which have a cross-sectional area smaller than that of the scavenging passage 16 are provided in addition to the scavenging passage 16. The switching valve 34 is fixed onto the valve shaft 37 pivotably mounted on the cylinder block 1, and the tip of an arm 38 fixed onto the valve shaft 37 is connected to the accelerator pedal 24 by means of a wire 39. When the acceleration pedal 24 is not depressed, that is, at the time of iding, the through-hole 33 of the switching valve 34 is aligned with the second bypass passage 36 as shown in FIG. 11. On the other hand, when the acceleration pedal 24 is depressed, the switching valve 34 rotates in the counter-clockwise direction and, as a result, the through-hole 33 of the switching valve 34 is aligned with the first bypass passage 35. After this, when the acceleration pedal 24 is further depressed, the through-hole 33 of the switching valve 34 is aligned with the scavenging passage 16. When the switching valve 34 is positioned in the position shown in FIG. 11, the fresh combustible mixture in the crank room 8 is introduced into the scavenging passage 16 via the through-hole 33 and the second bypass passage 36. As is apparent from FIG. 11, the length of the second bypass passage 36 is longer than that of the first bypass passage 35. In addition, in this embodiment, a 2-cycle engine has a plurality of cylinders, and the exhaust passages 19 of all of the cylinders are interconnected to each other via a passage 19' located upstream of the exhaust control valve 29.

As mentioned above, when the engine is operating under a light load, as illustrated in FIG. 11, the fresh combustible mixture in the crank room 8 is introduced into the scavenging passage 16 via the through-hole 33 of the switching valve 34 and the second bypass 36, and then, into the combustion chamber 5 via the scavenging ports 15. Since the second bypass passage 36 has a small cross-sectional area and a long length, the fresh combustible mixture flowing in the second bypass 36 is subjected to the resisting operation due to the second bypass passage 36 and, as a result, the fresh combustible mixture flows into the combustion chamber 5 from the scavenging port 15 at a low speed similar to the case wherein, in FIG. 3, the scavenging control valve 25 is provided. In addition, when the engine is operating under a light load, since the opening degree of the throttle valve 14 is small, the vacuum level in the intake passage 12 is large. Consequently, when the piston 4 moves upwards, a large vacuum is produced in the crank room 8. Contrary to this, when the piston 4 moves downwards, the pressure in the crank room 8 is elevated. Thus, the vacuum and the pressure are alternately produced in the crank room 8. As a result of this, the fresh combustible mixture in the second bypass passage 36 is gradually introduced into the scavenging passage 16 while reciprocally moving within the second bypass passage 36 due to the above-mentioned alternate production of the vacuum and the pressure. Consequently, since the fresh combustible mixture remains in the second bypass passage 36 for a long time, while reciprocally moving in the second bypass 36, vaporization of the fuel in the second bypass passage 36 is promoted. In addition, since a part of the fresh combustible mixture introduced into the combustion chamber 5 due to the reciprocal movement of the fresh combustible mixture in the second bypass passage 36 is again sucked into the second bypass passage 36 when the vacuum is produced in the crank room 8, at this time the vaporization of the fuel contained in the fresh combustible mixture is further promoted and, at the same time, the fresh combustible mixture is reformed due to the heat exchanging operation between the fresh combustible mixture and the residual burned gas in the combustion chamber. By providing the bypass passage as mentioned above, since the vaporization of the liquid fuel contained in the fresh combustible mixture is promoted and, at the same time, the fresh combustible mixture is reformed before the fresh combustible mixture is introduced into the combustion chamber 5, it is possible to easily create an active thermoatmosphere in the combustion chamber 5. As a result of this, it is possible to ensure an active thermoatmosphere combustion when the engine is operating under a partial load.

As mentioned previously, when the accelerator pedal 24 is depressed and, thus, the level of the load of the engine is increased, the fresh combustible mixture is introduced into the scavenging passage 16 via the first bypass passage 35, which has a length shorter than that of the second bypass passage 36. On the other hand, when the acceleration pedal 24 is further depressed and, thus, the engine is operating under a heavy load, the fresh combustible mixture in the crank room 8 is directly introduced into the scavenging passage 16 via the through-hole 33 of the switching valve 34. Consequently, at this time, the flow resistance which the fresh combustible mixture is subjected to is reduced, whereby a desired high output power of the engine can be obtained.

FIG. 12 illustrates the case wherein the present invention is applied to a 4-cycle engine. In FIG. 12, 40 designates a cylinder block, 41 a piston reciprocally movable in a cylinder bore 42 formed in the cylinder block 40, 43 a cylinder head fixed into the cylinder block 40 and 44 a comnbustion chamber formed between the piston 41 and the cylinder head 43; 45 designates an intake port, 46 an intake valve, 47 an intake manifold and 48 a carburetor; 49 designates a throttle valve of the carburetor 48, 50 an exhaust port, 51 an exhaust valve, 52 an exhaust manifold, and 62 a spark plug. An arm 53 is fixed onto the throttle valve 49, and the tip of the arm 53 is connected to the accelerator pedal 55 via a wire 54. On the other hand, a flow control valve 57 is disposed in an intake passage 56, at a position located downstream of and near the throttle valve 49, and is fixed onto a valve shaft 58 pivotably mounted on the intake manifold 47. A cam 59 is mounted on the valve shaft 58 and a wire 60, which is wound on the outer periphery of the cam 59, is connected to the accelerator pedal 55. The relationship between the opening area ratios of the throttle valve 49 and the flow control valve 57 is equal to the relationship between the opening area ratio of the throttle valve and the opening area ratio of the exhaust control valve, which relationship is shown by the curved line C in FIG. 6 and was hereinbefore described with reference to FIG. 3. Consequently, the flow control valve 57 is gradually opened and then fully opened before the throttle valve 49 reaches a point corresponding to the opening area ratio of approximately 40 percent. On the other hand, the flow control valve 57 remains fully opened when the opening area ratio of the throttle valve 49 is larger than approximately 40 percent. With the arrangement in FIG. 12, it is preferable that the duration of valve overlapping, wherein both the intake valve 46 and the exhaust valve 51 remain opened at the end of the exhaust stroke, be longer than that in a conventional 4-cycle engine.

When the flow control valve 57 remains slightly opened and, thus, the engine is operating under a light load, the vacuum level in the intake manifold 47 is considerably large. On the other hand, since the pressure in the combustion chamber 44 and in the exhaust port 50 is larger than the atmospheric pressure at the end of the exhaust stroke, when the intake valve 46 is opened at the end of the exhaust stroke, the burned gas in the combustion chamber 44 blows back into the intake port 45 via the intake valve 46. The more the timing of the opening operation of the intake valve 46 is advanced, that is, the more the duration of the valve overlapping is elongated, the more the amount of the burned gas blowing back into the intake port 50 is increased. As mentioned above, since a large amount of the burned gas blows back into the intake manifold 47 in an engine according to the present invention, the vaporization of the liquid fuel in the intake manifold 47 is promoted and, at the same time, the fresh combustible mixture in the intake manifold 47 is reformed. In addition, the promotion of the vaporization causes a uniform distribution of the fuel into the plurality of cylinders and also causes an improvement in the responsiveness of the engine with respect to the depressing operation of the accelerator pedal. If a uniform distribution of the fuel into the plurality of cylinders can not be obtained as in a conventional engine, the air-fuel ratio of the fresh combustible mixture becomes irregular among the respective cylinders. Consequently, when a lean air-fuel mixture is used, the air-fuel ratio in one of the plurality of cylinders becomes large and is increased beyond the range wherein ignition can be caused. Consequently, in a conventional engine, in order to prevent the air-fuel ratio in all of the plurality of cylinders from being increased beyond the range wherein the ignition can be caused, it is necessary to use a fresh combustible mixture having a relatively small air-fuel ratio and, as a result, it is difficult to use a lean air-fuel mixture. Contrary to this, in the present invention, since a uniform distribution of the fuel into the plurality of cylinders can be obtained, a lean air-fuel mixture can be used. Particularly at the time of idling and at the time when the engine is operating under a light load, wherein a satisfactory vaporizating operation of fuel cannot be obtained in a conventional engine, the distribution of the fuel into the plurality of cylinders becomes uniform in an engine according to the present invention. As a result of this, since good combustion can be obtained in all of the cylinders, the fuel consumption is greatly improved.

As mentioned above, in order to effectively promote the vaporization of fuel and reform the fresh combustible mixture, it is preferable that a large amount of the burned gas be caused to blow back into the intake manifold 47 as much as possible. To this end, it is preferable that an exhaust control valve 61 be disposed in an exhaust pipe 52′ as illustrated in FIG. 12. The exhaust control valve 61 is caused to rotate by means of a wire 63 connected to the accelerator pedal 55 in the same manner as the exhaust control valve 29 illustrated in FIG. 8. The relationship between the opening area ratios of the exhaust control valve 61 and the throttle valve 49 is equal to the relationship between the opening area ratio X of the exhaust control valve and the opening area ratio Y of the throttle valve, shown by the curved line D in FIG. 6 and described with reference to FIG. 3. Consequently, since the flow rate of the exhaust gas is reduced by the exhaust control valve 61 when the exhaust control valve 61 is slightly opened, that is when the engine is operating under a light load, the pressure in the combustion chamber 44 at the time of valve overlapping is greater than in the case wherein the exhaust control valve 61 is fully opened. As a result of this, a large amount of the exhaust gas can be caused to blow back into intake manifold 47.

FIG. 13 illustrates another embodiment of a 4-cycle engine in which the vaporization of fuel can be further promoted and the fresh combustible mixture can be further reformed. Referring to FIG. 13, a reed valve 64 only permitting the downward flow of the fresh combustible mixture is provided, and an accumulator 66 having a diaphragm 65 therein is provided. An inside chamber 67 of the accumulator 66 is connected via a conduit 68 to the intake passage 56 upstream of the flow control valve 57 on one hand, while the inside chamber 67 is connected via a conduit 69 to the intake passage 56 downstream of the flow control valve 57 on the other hand. A small throttle valve 70 is disposed in the conduit 68 and is fixed onto a valve shaft 71 pivotably mounted on the conduit 68. A cam 72 is mounted on the valve shaft 71 and a wire 73 connected to the accelerator pedal 55 is wound on the outer periphery of the cam 72. In this embodiment, the exhaust control valve 61 is arranged in the exhaust manifold 52.

FIG. 15 shows the relationship between the opening area ratios of the throttle valve 49, the flow control valve 57, the exhaust control valve 61 and the small throttle valve 70. In FIG. 15, the abscissa X indicates the ratio (%) of an opening area to the full opening area of the throttle valve 49, and the ordinate Y indicates the ratio (%) of an opening area to the full opening area of the flow control valve 57, the exhaust control valve 61 and the small throttle valve 70. In FIG. 15, the curved line P indicates the relationship between the opening area ratios of the throttle valve 49 and the exhaust control valve 61, and the curved line Q indicates the relationship between the opening area ratios of the throttle valve 49 and the small throttle valve 70. In addition, in FIG. 15, the curved line R indicates the relationship between the opening area ratios of the throttle valve 49 and the flow control valve 57. The relationship between the opening area ratios of the throttle valve 49 and the exhaust control valve 61 which is shown by curved line P in FIG. 15, is equal to the relationship between the opening area ratio Y of the throttle valve and the opening area ratio X of the exhaust control valve, which is shown by the curved line D in FIG. 6. On the other hand, as is shown by the curved line R in FIG. 15, the flow control valve 57 remains fully closed when the opening area ratio of the throttle valve is less than 50 percent, while the flow control valve 57 is rapidly opened and then fully opened when the opening area ratio of the throttle valve becomes larger than 50 percent. In addition, as is shown by the curved line Q in FIG. 15, the small throttle valve 70 is gradually opened as the throttle valve 49 is opned, and the small throttle valve 70 is fully opened when the flow control valve 37 is fully opened.

As mentioned above, since the flow control valve 57 remains fully closed when the engine is operating under a partial load, the fresh combustible mixture introduced into the intake passage 56 via the reed valve 64 is fed into the intake passage 56 located downstream of the flow control valve 57 via the small throttle valve 70, the conduit 68, the inside chamber 67 of the accumulator 66 and the conduit 69. On the other hand, the burned gas blowing back into the intake port 45 from the combustion chamber 44 is fed into the inside chamber 67 of the accumulator 66 via the conduit 69. Consequently, in the embodiment illustrated in FIG. 13, the burned gas and the fresh combustible mixture are mixed with each other and, thus, the heat exchanging operation therebetween is carried out. As a result of this, the vaporization of fuel is promoted and, at the same time, the fresh combustible mixture is reformed. In the embodiment illustrated in FIG. 13, it is preferable that the volume of the inside chamber 67 of the accumulator 66 be larger than that of the combustion chamber 44 when the piston is positioned at the bottom dead center position. That is, by setting the volume of the inside chamber 67 at the above-mentioned size, the unburned gas and the fresh combustible mixture can remain in the inside chamber 67 of the accumulator 66 for a long time, whereby the vaporization of fuel is further promoted and, at the same time, the combustible mixture is further reformed.

FIG. 14 illustrates a further embodiment of a 4-cycle engine. In the embodiment illustrated in FIG. 14, a conduit 69' is elongated as compared with the conduit 69 illustrated in FIG. 13, and an accumulator 66' has an inside chamber 67' having a volume which is smaller than the volume of the inside chamber 67 of the accumulator 66 illustrated in FIG. 13. As mentioned above, the conduit 69' in the embodiment illustrated in FIG. 14 has a considerably long length and, thus, the burned gas and the fresh combustible mixture are gradually fed into the intake port 45 while reciprocally moving in the conduit 69'. In this embodiment, since the reciprocal movement of the unburned gas and of the fresh combustible mixture is created in the conduit 69', the vaporization of fuel is further promoted and, at the same time, the combustible mixture is further reformed as compared to the embodiment illustrated in FIG. 13. On the other hand, in the 4-cycle engine illustrated in FIGS. 13 and 14, the flow control valve 57 remains fully opened when the engine is operating under a heavy load. Consequently, when the engine illustrated in FIGS. 13 and 14 is operating under a heavy load, a high output power similar to that in a conventional engine can be obtained.

FIG. 16 illustrates the case wherein the present invention is applied to a rotary piston engine. Referring to FIG. 16, 80 designates a housing, 81 a rotor rotating in the direction T and having three corners which slide on the inner wall of the housing 80, 82 three combustion chambers, formed between the housing 80 and the rotor 81, and 83 a pair of spark plugs; 84 designates an intake port opening into the combustion chamber 82, 85 an intake branch passage connected to the intake port 84, 86 an intake manifold and 87 a carburetor; 88 designates a throttle valve of the carburetor 87, 89 an exhaust port opening into the combustion chamber 82, 90 an exhaust passage connected to the exhaust port 89 and 91 an exhaust manifold. An arm 92 is fixed onto the throttle valve 88 and the tip of the arm 92 is connected to the accelerator pedal 79 via a wire 93. A flow control valve 95 is disposed in an intake passage 94 located downstream of and near the throttle valve 88, and is fixed onto a valve shaft 96 pivotably mounted on the intake manifold 86. A cam 97 is mounted on the valve shaft 96 and a wire 98, which is wound on the outer periphery of the cam 97, is connected to the accelerator pedal 79. The relationship of the opening area ratios of the throttle valve 88 and the flow control valve 95 is equal to the relationship between the opening area ratios of the opening area ratio Y of the throttle valve and the opening area ratio X of the scavenging control valve, shown by the curved line C in FIG. 6 and described with reference to FIG. 3. Consequently, the flow control valve 95 is gradually opened and then, fully opened before the throttle valve 88 reaches a point corresponding to the opening area ratio of approximately 40 percent. On the other hand, the flow control valve 95 remains fully opened when the opening area ratio of the throttle valve 88 is larger than approximately 40 percent.

In a rotary piston engine illustrated in FIG. 16, the exhaust port 89 and the intake port 84 open into the same combustion chamber 82 at the end of the exhaust stroke. Consequently, when the level of the vacuum in the intake manifold 86 is large, that is, when the engine is operating under a partial load, a large amount of the burned gas blows back into the intake branch passage 85 from the combustion chamber 82 via the intake port 84 at the end of the exhaust stroke. Since a large amount of the burned gas blows back into the intake manifold 86, the vaporization of the liquid fuel in the intake manifold 86 is promoted and, at the same time, the fresh combustible mixture in the intake manifold 86 is reformed. In addition, the promotion of the vaporization causes a uniform distribution of the fuel into the plurality of cylinders and also causes an improvement in the responsiveness of the engine with respect to the depressing operation of the accelerator pedal 79. Further, the promotion of the vaporization enables a stable combustion to be obtained even if a lean air-fuel mixture is used. Particularly at the time of idling and at the time when the engine is operating under a light load, wherein a satisfactory vaporizating operation of fuel cannot be obtained in a conventional engine, the distribution of fuel into the cylinders becomes uniform in an engine according to the present invention. As a result of this, since good combustion can be obtained in all of the cylinders, the fuel consumption is greatly improved.

As mentioned above, in order to effectively promote the vaporization of fuel and reform the combustible mixture, it is preferable that a large amount of the burned gas be caused to blow back into the intake manifold 86. To this end, it is preferable that an exhaust control valve 99 be disposed in an exhaust pipe 91' as illustrated in FIG. 16. The exhaust control valve 99 is caused to rotate by means of a wire 100 connected to the accelerator pedal 79, in the same manner as the exhaust control valve 29 illustrated in FIG. 8. The relationship between the opening area ratios of the exhaust control valve 99 and the throttle valve 88 is equal to the relationship between the opening area ratio X of the exhaust control valve and the opening area ratio Y of the throttle valve, shown by the curved line D in FIG. 6 and described with reference to FIG. 3. Consequently, the flow rate of the exhaust gas is prevented by the exhaust control valve 99 when the exhaust control valve 99 is slightly opened, that is, when the engine is operating under a light load, and the pressure in the combustion chamber 82 at the end of the exhaust stroke is greater as compared with the case wherein the exhaust control valve 99 is fully opened. As a result of this, a large amount of the burned gas can be caused to blow back into the intake manifold 86.

FIG. 17 illustrates another embodiment of a rotary piston engine in which the vaporization of fuel can be further promoted and the fresh combustible mixture can be further reformed. Referring to FIG. 17, a reed valve 101 only permitting the downward flow of the fresh combustible mixture is provided, and an accumulator 66 having a diaphragm 102 therein is provided. An inside chamber 104 of the accumulator 103 is connected via a conduit 105 to the intake passage 94 upstream of the flow control valve 95, on one hand, while the inside chamber 104 is connected via a conduit 106 to the intake passage 94 downstream of the flow control valve 95, on the other hand. A small throttle valve 107 is disposed in the conduit 105 and is fixed onto a valve shaft 108 pivotably mounted on the conduit 105. A cam 109 is mounted on the valve shaft 108 and a wire 110 connected to the accelerator pedal 79 is wound on the outer periphery of the cam 109. The relationship between the opening area ratios of the throttle valve 88, the flow control valve 95, the small throttle valve 107 and the exhaust control valve 99, is equal to the relationship between the opening area ratios of the corresponding throttle valve 49, flow control valve 57, small throttle valve 70 and exhaust control valve 61 illustrated in FIG. 13, which relationship is shown in FIG. 15. In this embodiment, the exhaust control valve 99 is arranged in the exhaust manifold 91.

In this embodiment, in the same manner as described with reference to FIG. 13, since the flow control valve 95 remains fully closed when the engine is operating under a partial load, the fresh combustible mixture introduced into the intake passage 94 via the reed valve 101 is fed into the intake passage 94 downstream of the flow control valve 95 via the small throttle valve 107, the conduit 105, the inside chamber 104 of the accumulator 103 and the conduit 106. On the other hand, the burned gas blowing back into the intake branch passage 85 from the combustion chamber 82 at the end of the exhaust stroke is fed into the inside chamber 104 of the accumulator 103 via the conduit 106. Consequently, the unburned gas and the fresh combustible mixture are mixed with each other and, thus, the heat exchanging operation therebetween is carried out. As a result of this, the vaporization of fuel is promoted and, at the same time, the fresh combustible mixture is reformed. In addition, as is described with reference to FIG. 13, in the embodiment illustrated in FIG. 17, it is also preferable that the volume of the inside chamber 104 of the accumulator 103 be larger than the total volume of the combustion chambers 82. Furthermore, in the embodiment illustrated in FIG. 17, the conduit 106 may be elongated similar to the conduit 69' illustrated in FIG. 14.

In all of the embodiments hereinbefore described, when the engine is operating under a heavy load, the operation of the engine according to the present invention is equal to that of a conventional engine. Consequently, in all of the embodiments of the engine according to the present invention, the engine may be provided with an exhaust gas recirculating device for recirculating the exhaust gas into the intake system of the engine only when the engine is operating under a heavy load.

The active thermoatmosphere combustion causes the reduction in the amount of harmful HC components in the exhaust gas and also causes a considerable improvement in fuel consumption. In addition, even if a lean air-fuel mixture is used, since an active thermoatmosphere combustion is caused, a amount of harmful $NO_x$ components can be reduced. Particularly in a multi-cylinder engine, since the distribution of fuel into the cylinders becomes uniform, a lean air-fuel mixture can be used as mentioned previously and, at the same time, stable combustion can be obtained in all of the cylinders. As a result of this, the irregularity in the torque generated in the respective cylinders is extremely minimized and the vibration of the engine is reduced. In addition, when the active thermoatmosphere combustion is carried out, ignition delay does not occur and, as a result, quiet operation of the engine can be effected at the time of idling and at the time when the engine is operating under a partial load.

While the invention has been described by reference to specific embodiments chosen for purposes of illustration, it should be apparent that numerous modifications could be made thereto by those skilled in the art without departing from the spirit and scope of the invention.

What is claimed is:

1. A method of combustion in a 2-cycle engine having therein a combustion chamber and a crank room which are interconnected to each other via a scavenging passage which opens into the combustion chamber through a scavenging port having a transverse cross-section which is approximately equal to that of the scavenging passage, said method comprising the steps of:

feeding a fresh combustible fuel mixture into said crank room;

compressing the fresh combustible fuel mixture in said crank room;

leading the fresh combustible fuel mixture in said crank room into said scavenging passage;

restricting the velocity of the flows of the fresh combustible fuel mixture flowing in said scavenging passage in a region thereof close to said crank room when the engine is operating under a partial load;

feeding the fresh combustible mixture at a slower velocity, relative to that entering the passage, from the scavenging passage into said combustion chamber; and discharging exhaust gas in said combustion chamber into the atmosphere.

2. A method as claimed in claim 1, wherein the flow rate of the exhaust gas from the combustion chamber is restricted for suppressing the flow and turbulence of burned gas in the combustion chamber so as to maintain the residual burned gas at a high temperature.

3. A method as claimed in claim 1, wherein a squish flow is created in the combustion chamber at the end of the compression stroke for control of the combustion of the active thermoatmosphere.

4. A method as claimed in claim 1, wherein the heat exchanging operation between the residual burned gas and the fresh combustible mixture is carried out for a long duration before the fresh combustible mixture is fed into the combustion chamber when the engine is operating under a partial load.

5. A method as claimed in claim 4, wherein reciprocal movement of the fresh combustible mixture is caused before the fresh combustible mixture is fed into the combustion chamber.

6. A method as claimed in claim 1, wherein said fresh combustible mixture fed into the combustion chamber generates extremely weak turbulence therein.

7. A method as claimed in claim 6, wherein said fresh combustible mixture is fed into the combustion chamber towards the central portion of the combustion chamber.

8. A 2-cycle internal combustion engine comprising:

a cylinder block having a cylinder bore and a crank room therein;

a piston having an approximately flat top surface and reciprocably movable in said cylinder bore, said piston and said cylinder bore defining a combustion chamber;

a scavenging passage having a scavenging port at one end thereof which opens into said combustion chamber and fluidly communicating said combustion chamber with said crank room at the other end thereof for feeding a fresh combustible fuel mixture into said combustion chamber, said scavenging port having a transverse cross section which is approximately equal to that of the scavenging passage;

an exhaust passage having an exhaust port opening into said combustion chamber for discharging burned gas from said combustion chamber into the atmosphere; and restricting means in said scavenging passage adjacent the other end thereof where said scavenging passage opens into said crank room for restricting the velocity of the fresh combustible fuel mixture fed into said combustion chamber when the engine is operating under a partial load and for creating an active thermoatmosphere in said combustion chamber to cause self-ignition of the active thermoatmosphere.

9. A 2-cycle internal combustion engine as claimed in claim 8, wherein said engine further comprises another restricting means for restricting the flow rate of the exhaust gas from said combustion chamber when the engine is operating under a partial load.

10. A 2-cycle internal combustion engine as claimed in claim 9, wherein said other restricting means comprises an exhaust control valve disposed in said exhaust passage.

11. A 2-cycle internal combustion engine as claimed in claim 10, wherein the volume of said exhaust passage located between said exhaust port and said exhaust control valve is smaller than that of said combustion chamber when the piston is positioned at the bottom dead center position.

12. A 2-cycle internal combustion engine as claimed in claim 8, wherein said restricting means comprises a scavenging control valve.

13. A 2-cycle internal combustion engine as claimed in claim 8, wherein said restricting means comprises at least one bypass passage having a relatively long length and communicating said scavenging passage with said crank room.

14. A 2-cycle internal combustion engine as claimed in claim 13, wherein said restricting means further comprises a switching valve for feeding the fresh combustible mixture into said combustion chamber via said bypass passage when the engine is operating under a partial load.

15. A 2-cycle internal combustion engine as claimed in claim 8, wherein the cross-sectional area of said scavenging passage is gradually increased towards the scavenging port.

16. An internal combustion engine as claimed in claim 8, wherein said restricting means comprises a flow control valve which is gradually opened as the level of the load of the engine is increased when the engine is operating under a partial load.

17. A method of combustion in a 2-cycle engine having a carburetor having a throttle valve and having therein a combustion chamber and a crank room which are interconnected to each other via a scavenging passage which opens into the combustion chamber through a scavenging port having a transverse cross-section which is approximately equal to that of the scavenging passage, said method comprising the steps of:

feeding with the throttle valve a fresh combustible fuel mixture into said crank room;

compressing the fresh combustible fuel mixture in said crank room;

leading the fresh combustible fuel mixture in said crank room into said scavenging passage;

adjustably restricting the velocity of the flows of the fresh combustible fuel mixture flowing in said scavenging passage in a region thereof close to said crank room when the engine is operating under a partial load in proportion to the degree of opening of the throttle valve when it is open less than 40% and substantially not restricting the flows in said scavenging passage when the throttle valve is open 40% or more;

feeding the fresh combustible mixture at a slower velocity, relative to that entering the passage, from the scavenging passage into said combustion chamber; and discharging exhaust gas in said combustion chamber into the atmosphere.

18. A 2-cycle internal combustion engine comprising:

a cylinder block having a cylinder bore and a crank room therein;

a carburetor having a throttle valve therein;

a piston having an approximately flat top surface and reciprocably movable in said cylinder bore, said piston and said cylinder bore defining a combustion chamber;

a scavenging passage having a scavenging port at one end thereof which opens into said combustion chamber and fluidly communicating said combustion chamber with said crank room at the other end thereof for feeding a fresh combustible fuel mixture into said combustion chamber, said scavenging port having a transverse cross-section which is approximately equal to that of the scavenging passage;

an exhaust passage having an exhaust port opening into said combustion chamber for discharging burned gas from said combustion chamber into the atmosphere; and a rotatable scavenging control valve in said scavenging passage adjacent the other end thereof where said scavenging passage opens into said crank room for restricting the velocity of the fresh combustible fuel mixture fed into said combustion chamber when the engine is operating under a partial load and for creating an active thermoatmosphere in said combustion chamber to cause self-ignition of the active thermoatmosphere, said scavenging control valve opening in proportion to the opening of the throttle valve, being fully open when the throttle valve is 40% open and remaining fully open when the throttle valve is open more than 40%.

* * * * *

UNITED STATES PATENT AND TRADEMARK OFFICE

CERTIFICATE OF CORRECTION

PATENT NO. : 4,185,598

DATED : January 29, 1980

INVENTOR(S) : Sigeru Onishi

It is certified that error appears in the above—identified patent and that said Letters Patent is hereby corrected as shown below:

On The Title Page Assignee should read -- Toyota Jidosha Kogyo Kabushiki Kaisha, Toyota, Japan, part interest- Signed and Sealed this

*Twelfth* Day of *May 1981*

[SEAL]

*Attest:*

RENE D. TEGTMEYER

*Attesting Officer*

*Acting Commissioner of Patents and Trademark*